US006641081B2

(12) United States Patent
Huang

(10) Patent No.: US 6,641,081 B2
(45) Date of Patent: Nov. 4, 2003

(54) APPARATUS OF TAPE DISPENSER TO HOLD THE TAIL OF TAPE

(76) Inventor: Harrison Huang, No. 23, Lin T'So Rd., Sheng Kang Hsien, Taichung Hsien (TW)

( * ) Notice: Subject to any disclaimer, the term of this patent is extended or adjusted under 35 U.S.C. 154(b) by 0 days.

(21) Appl. No.: 10/163,365

(22) Filed: Jun. 7, 2002

(65) Prior Publication Data

US 2003/0173452 A1 Sep. 18, 2003

(30) Foreign Application Priority Data

Mar. 12, 2002 (TW) ..... 91202858 U

(51) Int. Cl.[7] ..... B65H 75/32; B32B 31/00
(52) U.S. Cl. ..... 242/588; 156/577; 156/579
(58) Field of Search ..... 242/588, 588.2; 156/574, 577, 579, 523, 527, 526

(56) References Cited

U.S. PATENT DOCUMENTS 3,895,059 A * 7/1975 Link ..... 156/527
5,549,255 A * 8/1996 Huang ..... 156/579
5,641,377 A * 6/1997 Chung et al. ..... 156/577
6,257,298 B1 * 7/2001 Huang ..... 156/577

* cited by examiner

*Primary Examiner*—William A. Rivera
(74) *Attorney, Agent, or Firm*—Browdy and Neimark, P.L.L.C.

(57) ABSTRACT

A tape dispenser includes a handle, and a base plate which is disposed at an end of the handle, which has a tape mount pivoted at back side thereof and a seat member disposed at front side thereof. The seat member provides a cylinder at front side thereof for free rotating, a cutter at front end thereof above the cylinder and a plate at front end thereof between the cylinder and the cutter. An attracting piece is disposed on the plate of the seat member, which can produce static electricity on the surface thereof. The attracting piece has an adhesive layer at back side thereof, which can make the attracting piece secured at the plate and can prevent the static electricity on the attraction piece spreading to the seat member. Thus, the tail of the tape can be attracted by the attracting piece.

13 Claims, 6 Drawing Sheets

APPARATUS OF TAPE DISPENSER TO HOLD THE TAIL OF TAPE

FIELD OF THE INVENTION

The present invention relates to a packing tool, and more particularly to a tape dispenser, which can hold the tail of tape on the dispenser.

BACKGROUND OF THE INVENTION

FIG. 1 shows a conventional tape dispenser 90, which is applied to the workplace, such as the warehouse department of a factory, the post office or delivery company where need to pack boxes and the like a great quantity and frequently. Please refer to FIG. 1, the tape dispenser 90 disposes a tape roll thereon. The tape 91 is drawn out and runs along a cylinder 92 with a pressing piece 93 pressing the tape 91. Then the tape 91 is drawn to the cutter 94.

In operating, please refer to FIG. 2, operator holds the handle of the tape dispenser 90 and attaches the tail of the tape 91 on the box 95 first. Thus, operator can move the dispenser 90 to draw the tape 91 out to make it attached on the box 95. After packed the box 95, the operator can turn the dispenser 90 an angle to make the cutter 94 cutting the tape 91 off. However, when the cutter 94 cuts the tape 91 off, there is nothing to hold the tail of the tape 91 that will make the tape tail waving freely. Operator needs to holds the tail of the tape 91 to make it attached on another box 95 first, and then he/she can draw the dispenser 90 to make the tape 91 attached on the box.

An earlier invention to fix the problem is to provide a metal seat member, which is the element labeled 96 in FIG. 1 and FIG. 2. The metal seat member 96 can produce static electricity on the surface to make the plate, which is the element labeled 97 in FIG. 1 and FIG. 2, between the cylinder 92 and the cutter 94 attracting the tail of the tape 91. Thus, the plate 97 will attract the tail of the tape 91 the after the tape 91 being cut. But I found the seat member 96 can not concentrate the static electricity on the plate 97 only, the static electricity will spread to the entire seat member 96. So sometime the plate 96 is fail to attract the tape.

SUMMARY OF THE INVENTION

The primary object of the present invention is to provide a tape dispenser, which can hold the tail of tape fixedly after the tape being cut off.

According to the objective of the present invention, a tape dispenser comprises a handle. A base plate is disposed at an end of the handle, which has a tape mount pivoted at back side thereof and a seat member disposed at front side thereof. The seat member provides a cylinder for free rotating and a cutter. An attracting piece is disposed on the seat member between the cylinder and the cutter, which can produce static electricity on the surface thereof. Thus, the tail of the tape can be attracted by the attracting piece.

DETAIL DESCRIPTION OF THE INVENTION

Figure 1:
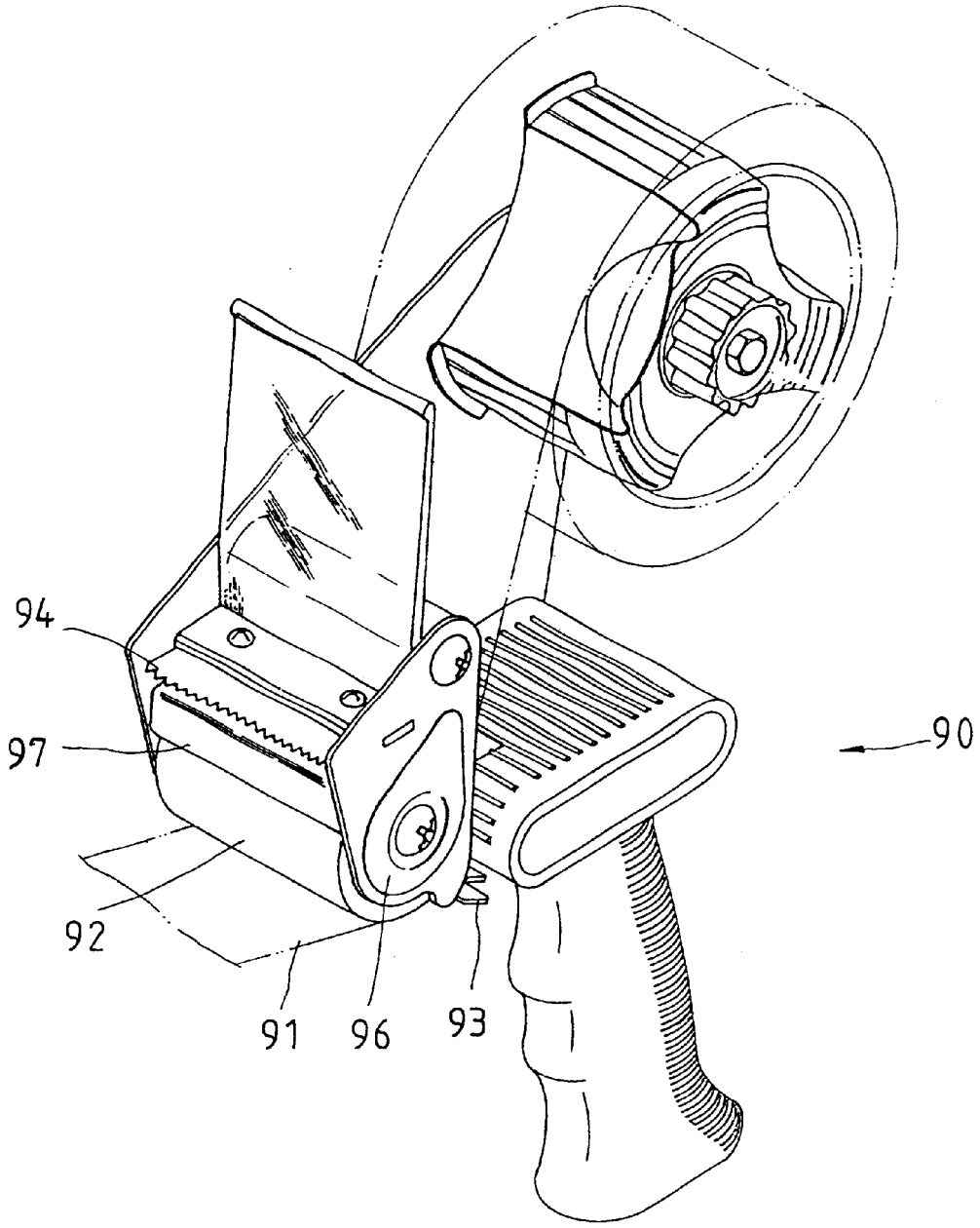
FIG. 1 PRIOR ART
FIG. 1 is a perspective view of a conventional tape dispenser.
Figure 2:
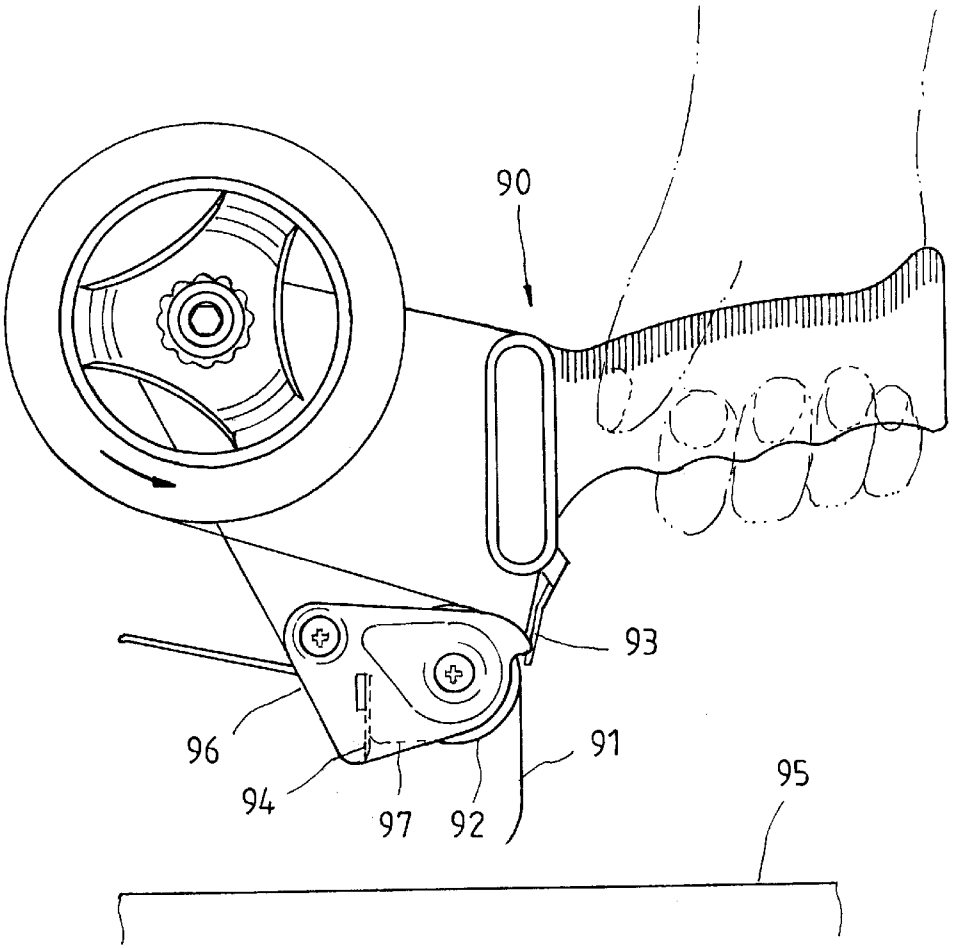
FIG. 2 PRIOR ART
FIG. 2 is a perspective view of the conventional tape dispenser in operating.
Figure 3:
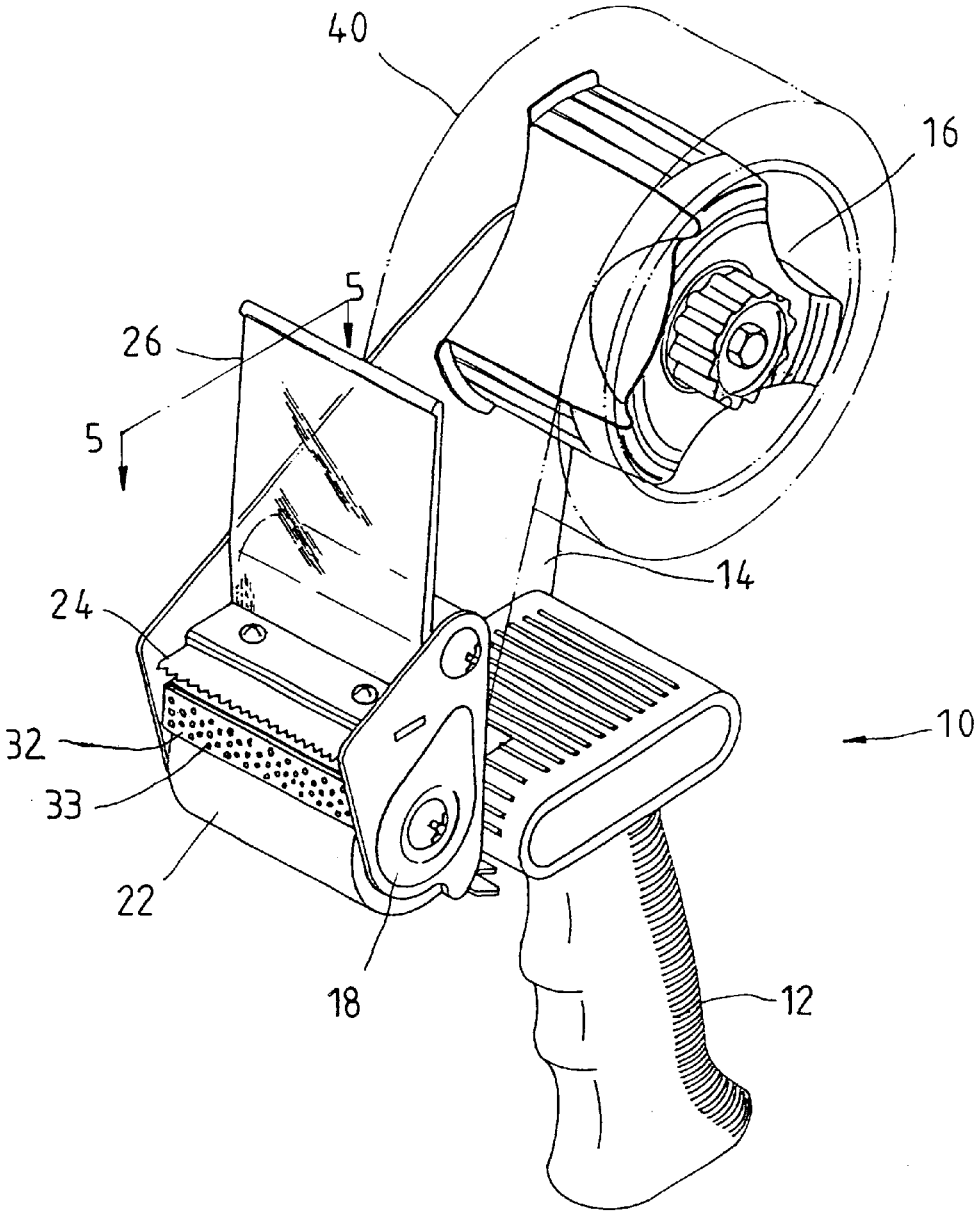
FIG. 3 is a perspective view of a prefer embodiment of the present invention.
Figure 4:
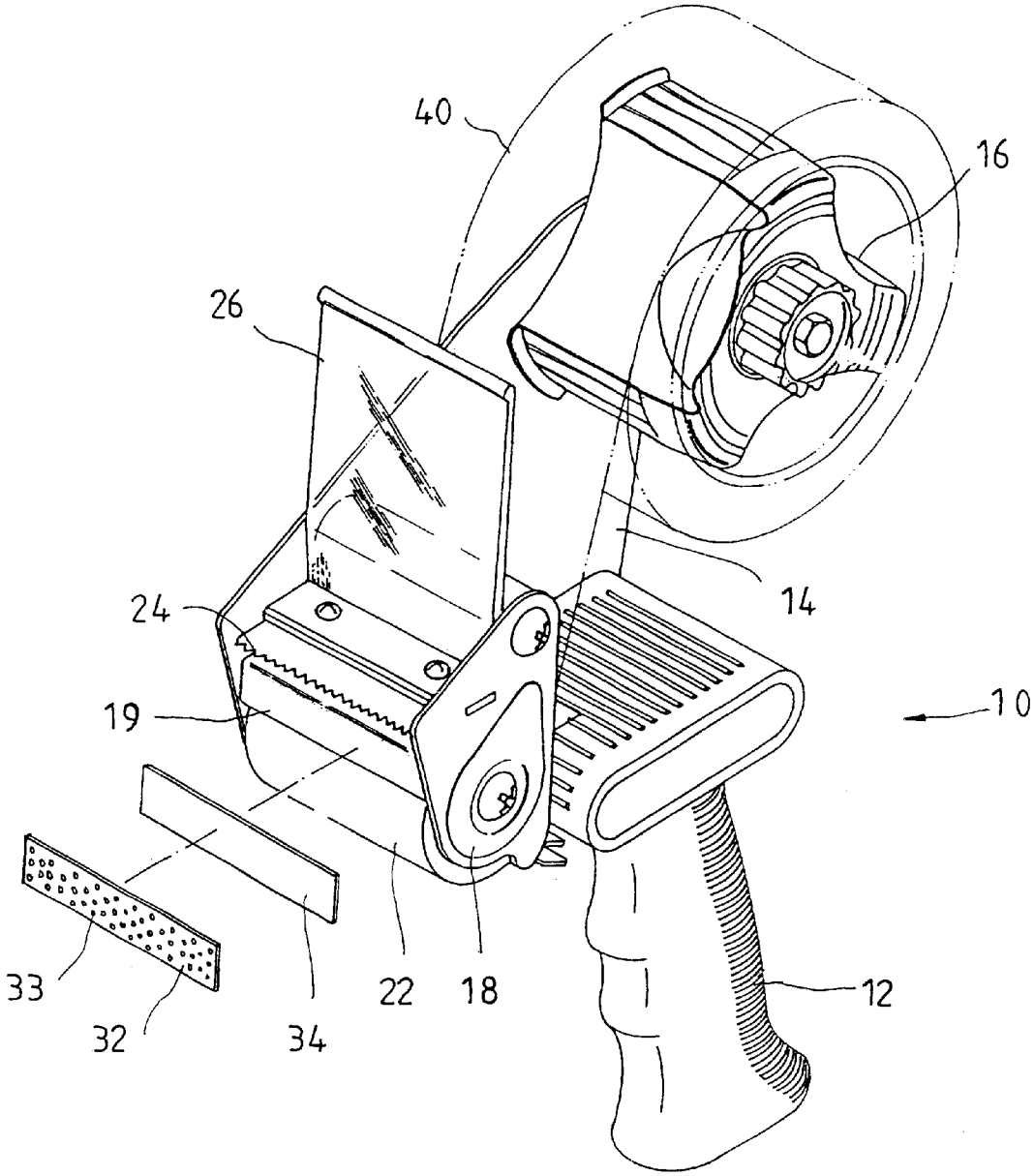
FIG. 4 is an exploded view of the prefer embodiment of the present invention.
Figure 5:
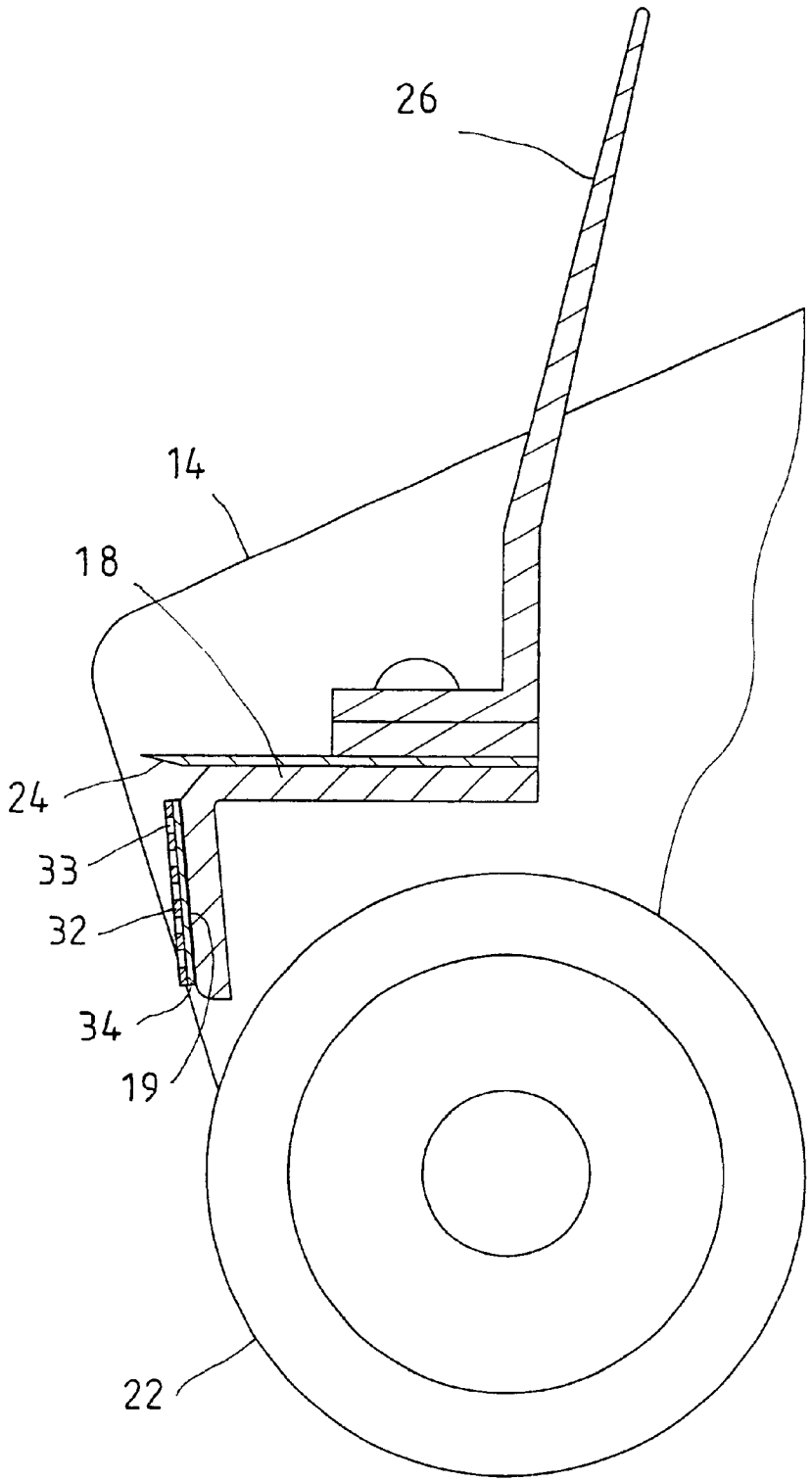
FIG. 5 is a sectional view along the 5—5 line in FIG. 3.

Please refer to FIGS. from FIG. 3 to FIG. 5, the prefer embodiment of the present invention provides a tape dispenser 10, which comprises a handle 12, a base plate 14 secured at the topside of the handle 12, a tape mount 16 pivoted at the back side of the base plate 14 and a seat member 18 secured at front side of the base plate 14. The seat member 18 pivots a cylinder 22 at front side thereof and secures a cutter 24 above the cylinder 22. The elements of the tape dispenser 10 are the same as the prior art, so I will not describe the detail.

Please refer to FIG. 4 and FIG. 5, the seat member 18 of the tape dispenser 10 has a rectangular plate 19 at front end thereof between the cylinder 22 and the cutter 24, which attaches an attracting piece 32 thereon. The attracting piece 32 is made of polyvinyl chloride (PVC), which has apertures 33 thereon. The area of the attracting piece 32 is substantial equal to the plate 19. The attracting piece 32 has an adhesive layer 34 at back side thereof for attaching the attracting piece 32 on the plate 19 securedly. In this prefer embodiment, the adhesive layer 34 of the attracting piece 32 is a twin adhesive piece, which is made of foam and has thickness of substantial 0.2 mm. There are other ways to attach the attracting piece 32 on the plate 19 of the seat member 18, such as providing a liquid adhesive on the back side of the attracting piece 19 to make the attracting piece 32 attached on the plate 19 directly. After the adhesive is solidified, it will form the adhesive layer. The attracting piece 32 on the plate 19 by hot pressing.

The attracting piece 32 is to provide the capacity of static electricity attraction, so the attracting piece 32 also can be chosen from another macromolecular material or metal piece, such as aluminum piece, which can produce static electricity easier and can hold the electric charges on the surface. In operating, the tape will rub against the attracting piece 32 rapidly to make the attracting piece 32 producing static electricity on the surface. This is we call it as "frictional electricity" in physics.

As we know, the foam and the adhesive are insulations, so the adhesive layer 34 of the attracting piece 32 has another function of isolating the attracting piece 32 from the plate 19 so that the static electricity cannot spread to the seat member 18. Thus, the static electricity is concentrated at the attracting piece 32 only to provide a larger static electricity attraction.

Figure 6:
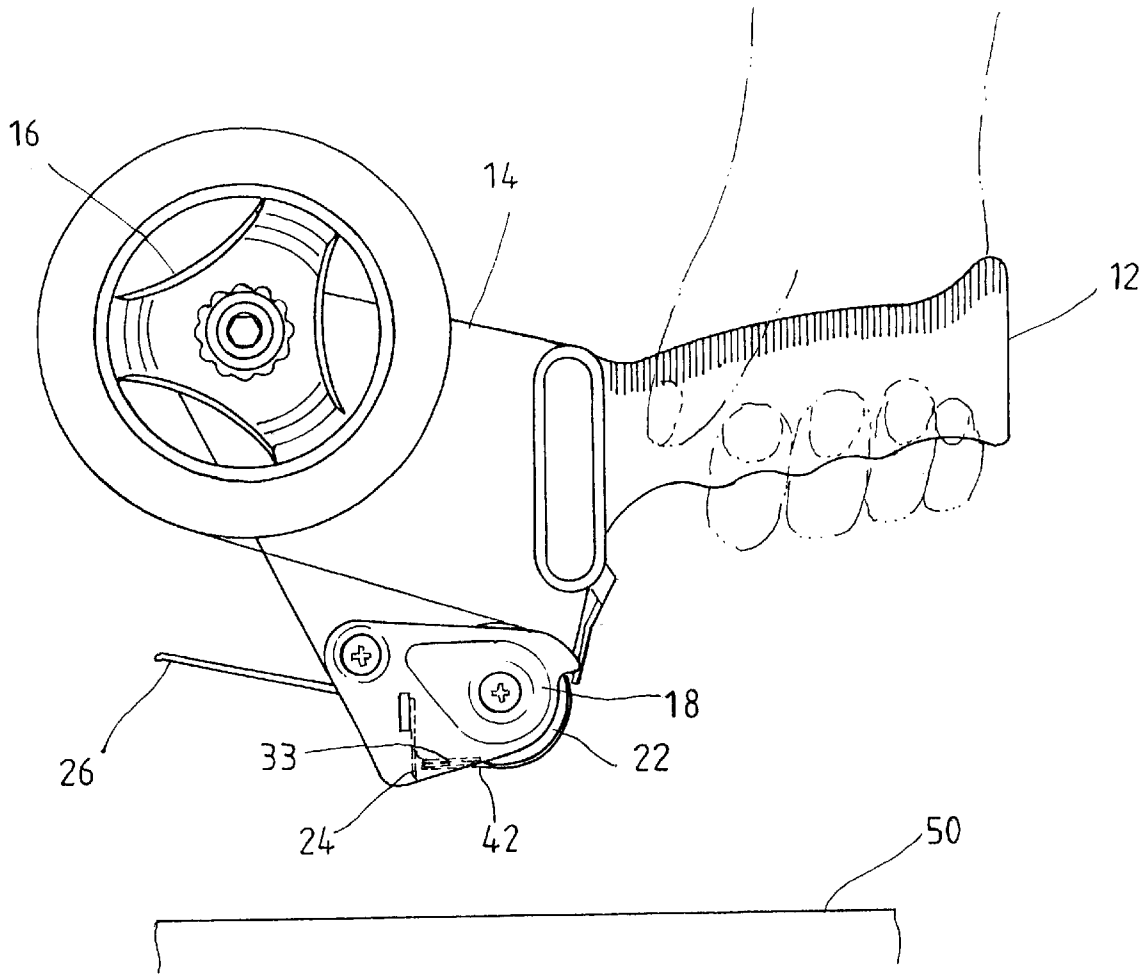
FIG. 6 is a perspective view of the prefer embodiment of the present invention in operating.

In operating, please refer to FIG. 6, when the user operates the tape dispenser 10 of the present invention make the tape 40 seal a box 50 and drives the cutter 24 to cut the tape 40, the tail of the tape 40 attracted by the attracting piece 32 by means of the static electricity produced on the attracting piece 32. Thus, the user can continue the next packing work without having to hold the tail of the tape 40. The efficiency of the packing work is greatly increased.

In the prefer embodiment as described above, I provide apertures 33 on the attracting piece 32 are to facilitate the attracting piece 32 attached on the plate 19 of the seat member 18 fixedly.

The advantages of the present invention are:

1. It only needs to attach the attracting piece on the seat member, there is no further element is added in the tape dispenser 10 of the present invention. It has lower cost than the prior art.

2. The adhesive layer further has a function of isolating the attracting piece from the seat member to prevent the static electricity spreading to the seat member. Thus, the attracting piece can securely hold the tail of the tape for a longer time, because of the static electricity is concentrated at the surface of the attracting piece.

What is claimed is:

1. A tape dispenser comprising a handle, a base plate disposed at an end of said handle, a rotatable tape mount engage on a first end of said base plate, a seat member disposed at a second end of said base plate, a cylinder rotatably engaged on said seat member near a cutter which is fixed on said seat member and an attracting piece separably engaged on said seat member between said cylinder and said cutter, which produces static electricity on an outer surface thereof.

2. The tape dispenser as defined in claim 1, wherein said attracting piece is made of macromolecular material.

3. The tape dispenser as defined in claim 2, wherein said attracting piece is made of polyvinyl chloride.

4. The tape dispenser as defined in claim 1, wherein said attracting piece has apertures.

5. The tape dispenser as defined in claim 1, wherein said attracting piece has an adhesive layer at an interior side thereof.

6. The tape dispenser as defined in claim 5, wherein said adhesive layer is a twin adhesive.

7. The tape dispenser as defined in claim 5, wherein said adhesive layer is made of insulating material.

8. A tape dispenser comprising a handle, a base plate disposed at an end of said handle, a rotatable tape mount engaged on a first end of said base plate, a seat member disposed at a second end of said base plate a cylinder rotatably engaged on said seat member near a cutter which is fixed on said seat member and an attracting piece separably engaged on said seat member between said cylinder and said cutter, which produces static electricity on an outer surface thereof, wherein said attracting piece has apertures.

9. The tape dispenser as defined in claim 8, wherein said attracting piece is made of macromolecular material.

10. The tape dispenser as defined in claim 8, wherein said attracting piece is made of polyvinyl chloride.

11. The tape dispenser as defined in claim 8, wherein said attracting piece has an adhesive layer at an interior side thereof.

12. The tape dispenser as defined in claim 11, wherein said adhesive layer is a twin adhesive.

13. The tape dispenser as defined in claim 11, wherein said adhesive layer is made of insulating material.

* * * * *